US010276988B2

(12) United States Patent
Zhao

(10) Patent No.: US 10,276,988 B2
(45) Date of Patent: Apr. 30, 2019

(54) ELECTRICAL CONNECTOR HAVING REARWARDLY EXTENDING METALLIC OUTER SHELL AROUND MOUNTING LEGS THEREOF

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 2 days.

(21) Appl. No.: 15/813,114

(22) Filed: Nov. 14, 2017

(65) Prior Publication Data

US 2018/0138641 A1 May 17, 2018

(30) Foreign Application Priority Data

Nov. 14, 2016 (CN) ..... 2016 1 1001224

(51) Int. Cl.

| | |
|---|---|
| ***H01R 24/00*** | (2011.01) |
| ***H01R 13/6594*** | (2011.01) |
| ***H01R 13/506*** | (2006.01) |
| ***H01R 13/631*** | (2006.01) |
| ***H01R 13/6595*** | (2011.01) |
| *H01R 24/60* | (2011.01) |

(52) U.S. Cl.

CPC ..... *H01R 13/6594* (2013.01); *H01R 13/506* (2013.01); *H01R 13/631* (2013.01); *H01R 13/6595* (2013.01); *H01R 24/60* (2013.01)

(58) Field of Classification Search

CPC ..... H01R 13/6581; H01R 13/6594; H01R 13/506; H01R 24/66; H01R 12/57; H01R 12/707

USPC ..... 439/629

See application file for complete search history.

(56) References Cited

U.S. PATENT DOCUMENTS

| | | | | |
|---|---|---|---|---|
| 7,922,535 | B1 * | 4/2011 | Jiang | H01R 13/5205 439/271 |
| 8,292,674 | B1 * | 10/2012 | Yang | H01R 12/57 439/587 |
| 8,827,742 | B2 * | 9/2014 | Wang | H01R 24/68 439/569 |
| 9,088,108 | B2 * | 7/2015 | Zhao | H01R 13/6581 |
| 9,093,797 | B2 * | 7/2015 | Zhao | H01R 12/707 |
| 9,385,484 | B2 * | 7/2016 | Chen | H01R 13/6594 |
| 9,490,595 | B2 * | 11/2016 | Little | H01R 13/6594 |
| 2012/0231661 | A1 * | 9/2012 | Song | H01R 12/707 439/607.4 |

(Continued)

*Primary Examiner* — Jean F Duverne

(74) *Attorney, Agent, or Firm* — Wei Te Chung; Ming Chieh Chang

(57) ABSTRACT

An electrical connector includes a contact module enclosed within a metallic inner shell, and a metallic outer shell attached upon the inner shell. The contact module includes an insulator and a plurality of terminals integrally formed with the insulator. The insulator includes a base and a tongue portion extending forwardly from the base. The inner shell forms a mating cavity in which the tongue portion extends. The side wall of the outer shell forms a front mounting leg and rear mounting leg. The front mounting leg extends horizontally with a notch/hole and a protrusion thereabouts while the rear mounting leg extends vertically at the rear end of the connector.

14 Claims, 14 Drawing Sheets

(56) References Cited

U.S. PATENT DOCUMENTS

| | | | |
|---|---|---|---|
| 2016/0233594 | A1 | 8/2016 | Zhao |
| 2016/0294105 | A1 | 10/2016 | Zhao |
| 2017/0077654 | A1 | 3/2017 | Yao |
| 2017/0133795 | A1 | 5/2017 | Guo |
| 2017/0302031 | A1 | 10/2017 | Cheng |

* cited by examiner

ELECTRICAL CONNECTOR HAVING REARWARDLY EXTENDING METALLIC OUTER SHELL AROUND MOUNTING LEGS THEREOF

FIELD OF THE DISCLOSURE

The invention is related to an electrical connector and the method of making the same.

DESCRIPTION OF RELATED ARTS

Chinese patent application publication CN105406256 discloses the electrical connector having an inner metallic shell enclosing a contact module, and an outer metallic shell secured to the inner shell wherein both the inner shell and the outer shell have the securing structures for retaining to the housing of the contact module. Anyhow, during mating, the relatively large insertion force is applied upon the receptacle connector, thus tending to push rearwardly the contact module away from the inner shell.

It is desired to provide an electrical connector with relatively strong retention between the shell and the contact module for resisting the insertion force during mating.

SUMMARY OF THE DISCLOSURE

To achieve the above desire, an electrical connector includes a contact module enclosed within a metallic inner shell, and a metallic outer shell attached upon the inner shell. The contact module includes an insulator and a plurality of terminals integrally formed with the insulator. The insulator includes a base and a tongue portion extending forwardly from the base. The inner shell forms a mating cavity in which the tongue portion extends. The outer shell extends rearwardly beyond the inner shell and forms a main body covering the inner shell and a rear cover extending rearwardly from the main body to cover the rear side of the base.

The base includes a tail portion having a step structure including an upper rear face, a lower rear face and a step therebetween. The rear cover covers the tail portion.

DETAILED DESCRIPTION OF THE PREFERRED EMBODIMENT

Figure 1:
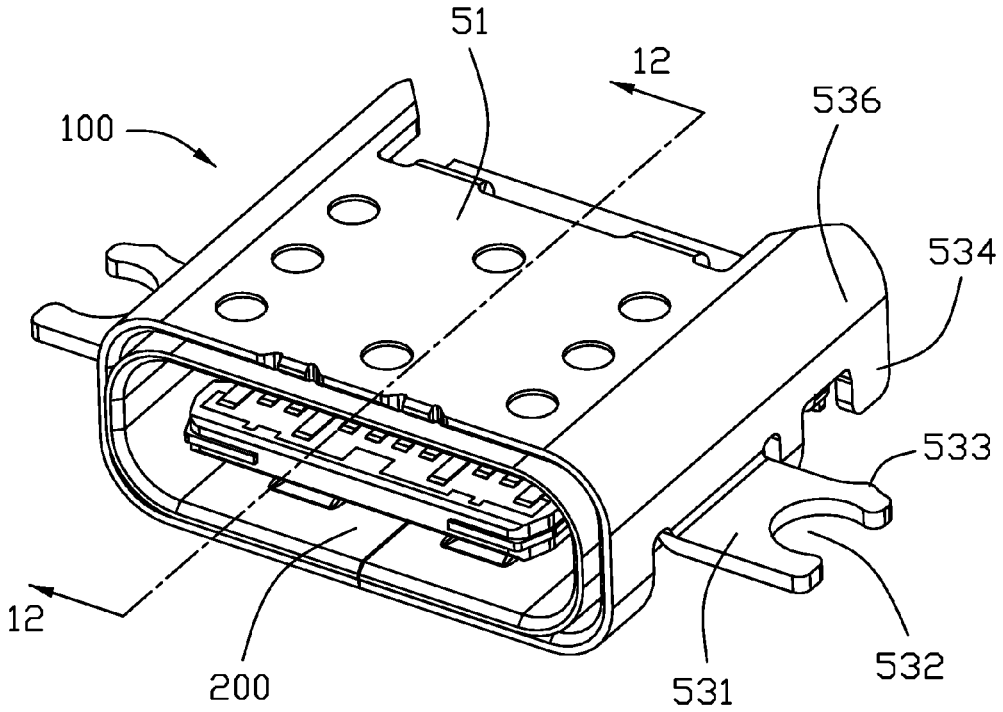
FIG. 1 is a front downward perspective view of an electrical connector according to the invention.
Figure 2:
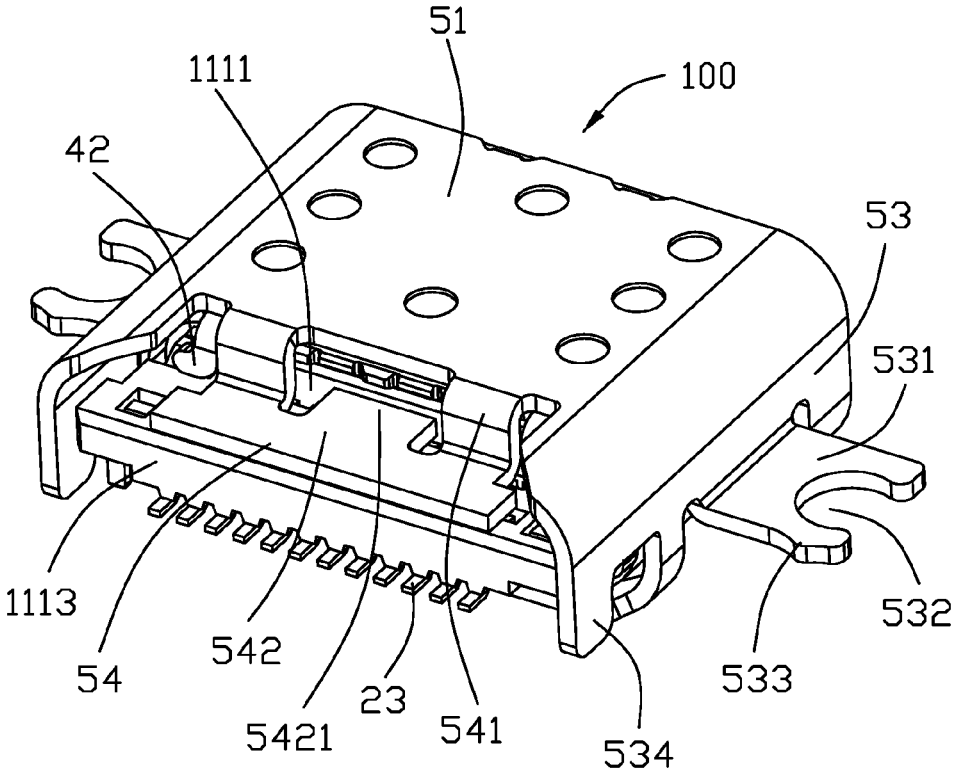
FIG. 2 is a rear downward perspective view of the electrical connector of FIG. 1.
Figure 3:
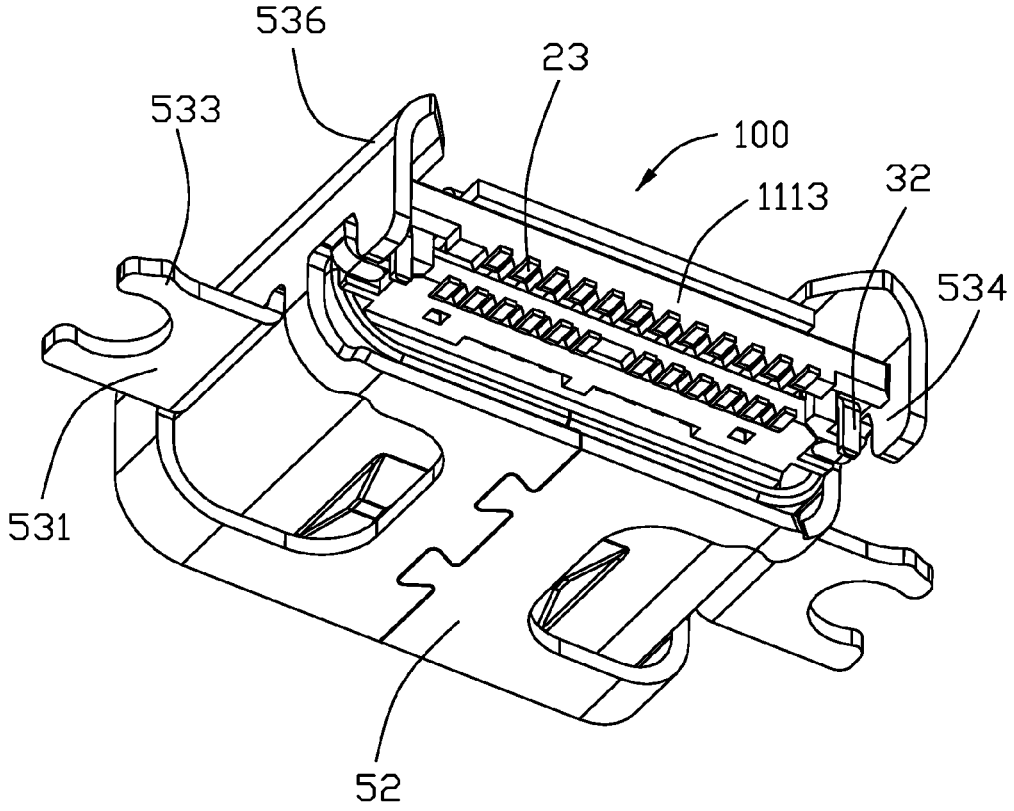
FIG. 3 is a rear upward perspective view of the electrical connector of FIG. 1.
Figure 4:
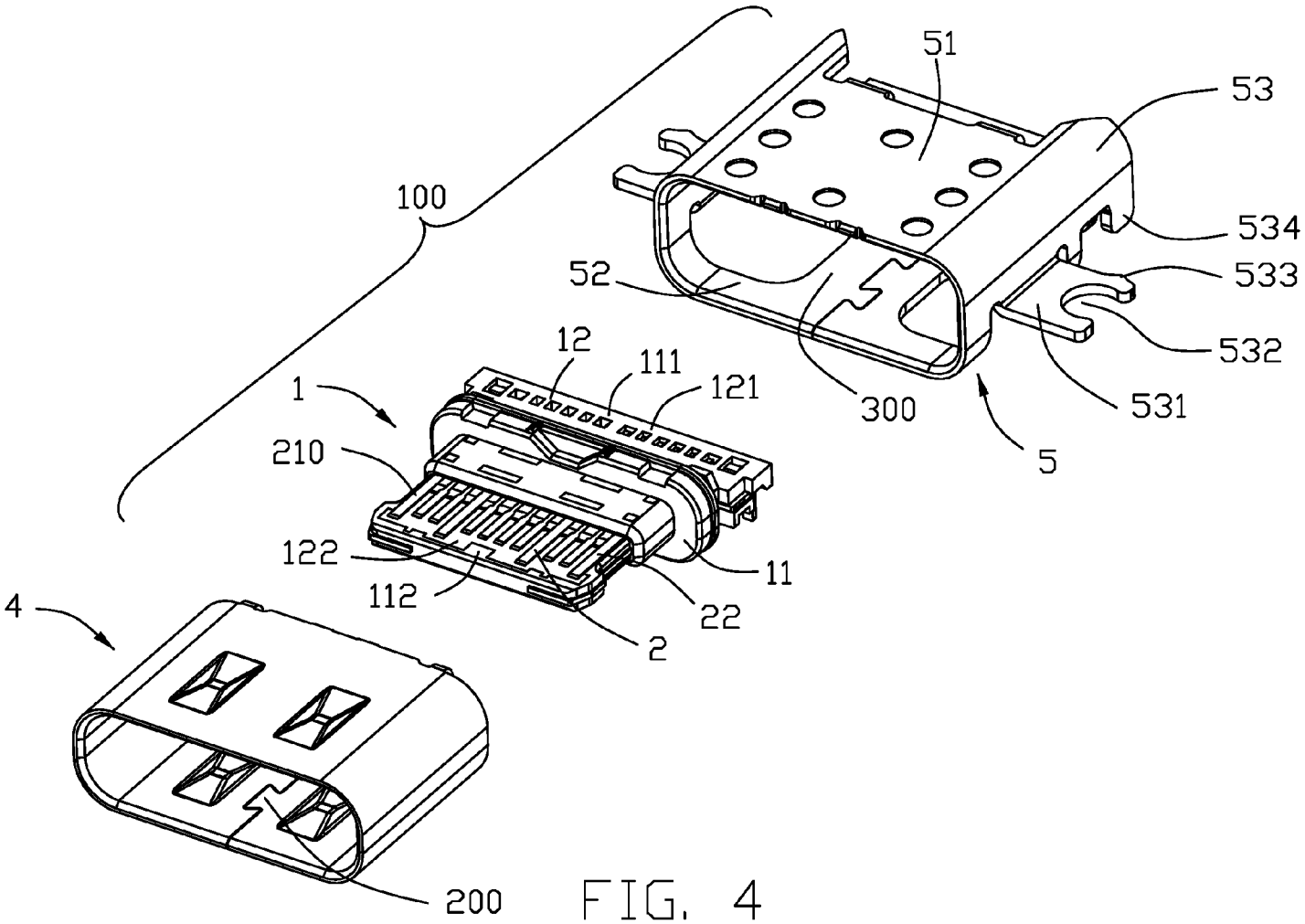
FIG. 4 is a front downward exploded perspective view of the electrical connector of FIG. 1.
Figure 5:
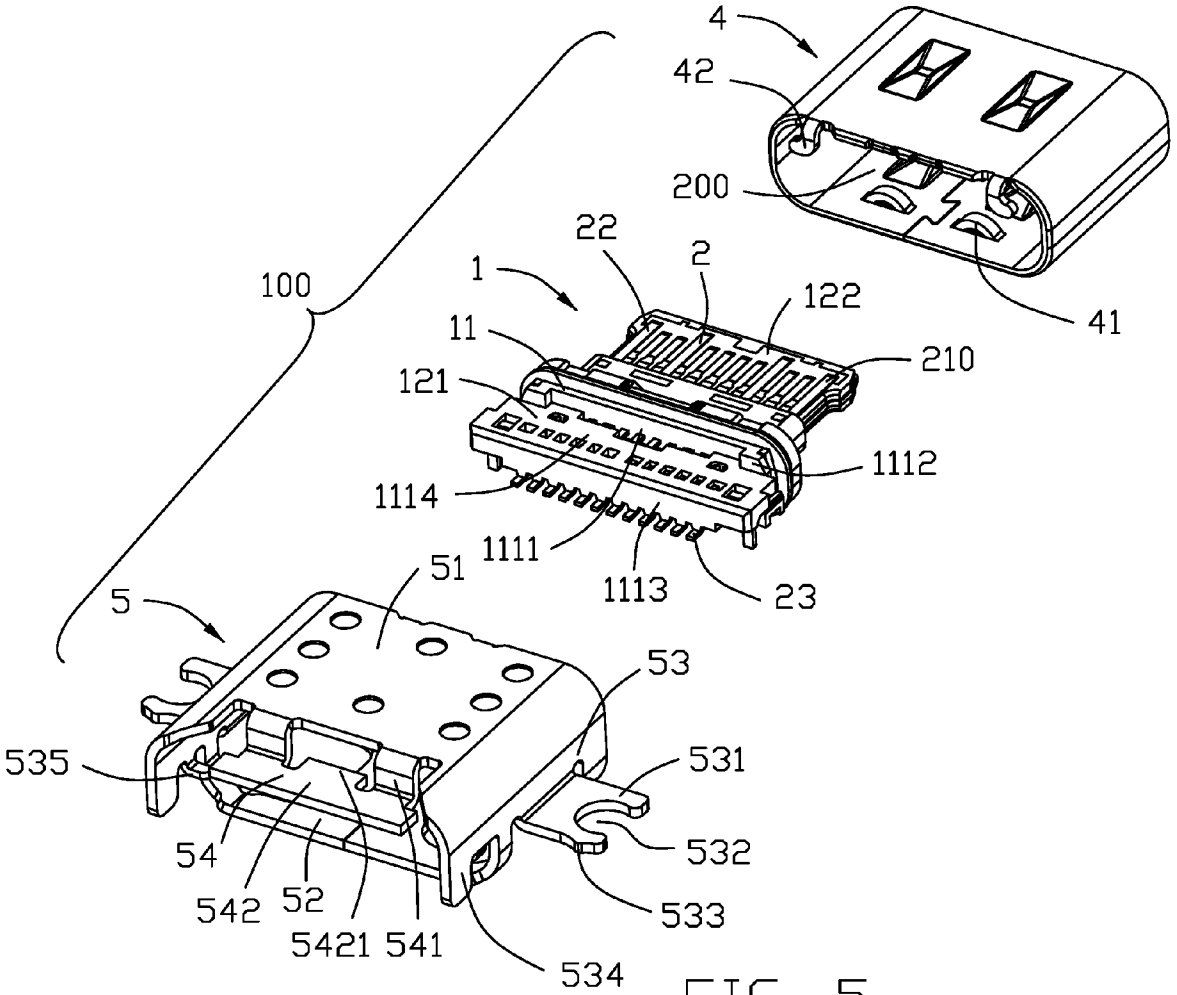
FIG. 5 is a rear downward exploded perspective view of the electrical connector of FIG. 2.
Figure 6:
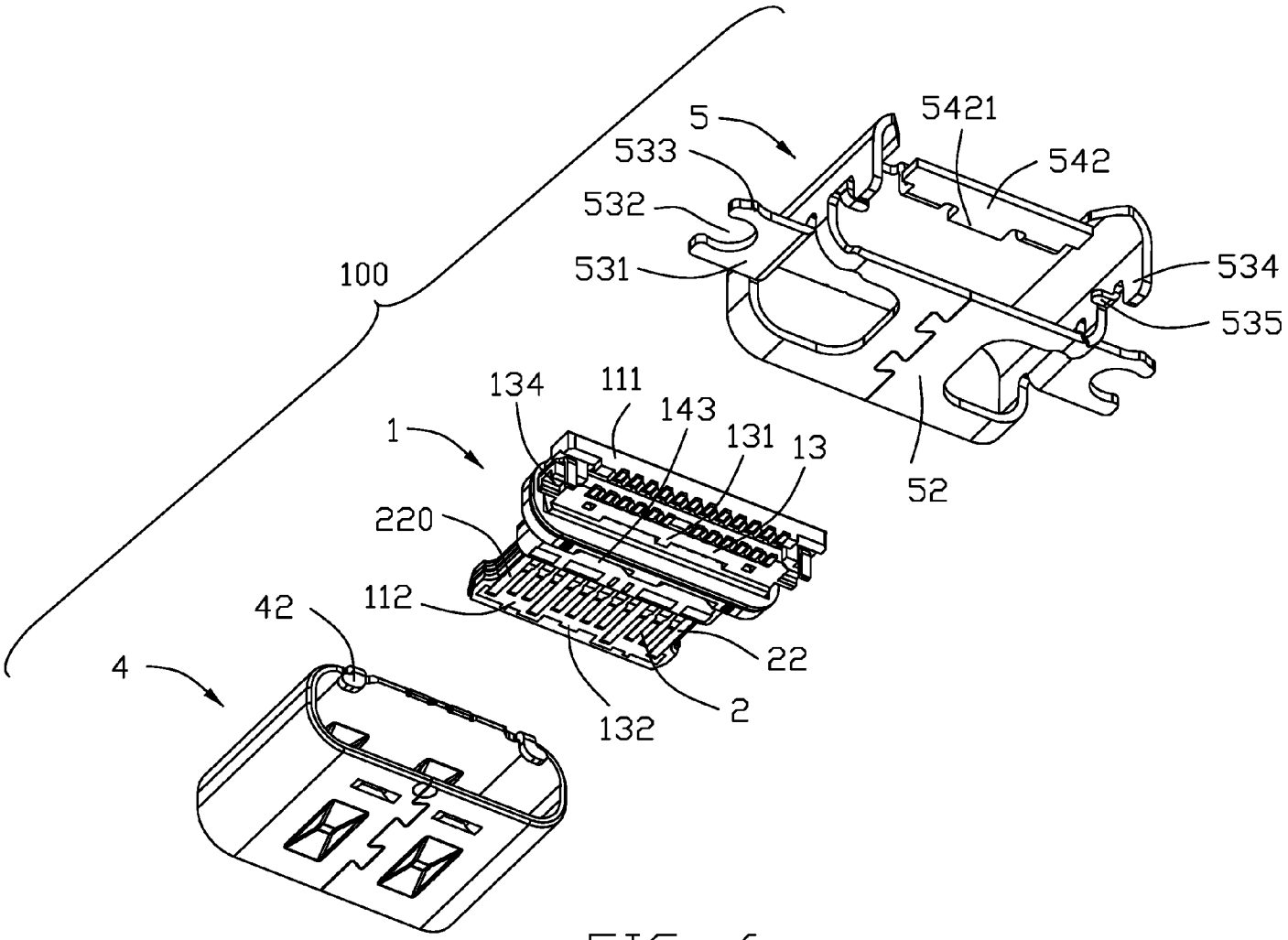
FIG. 6 is a rear upward exploded perspective view of the electrical connector of FIG. 4.
Figure 7:
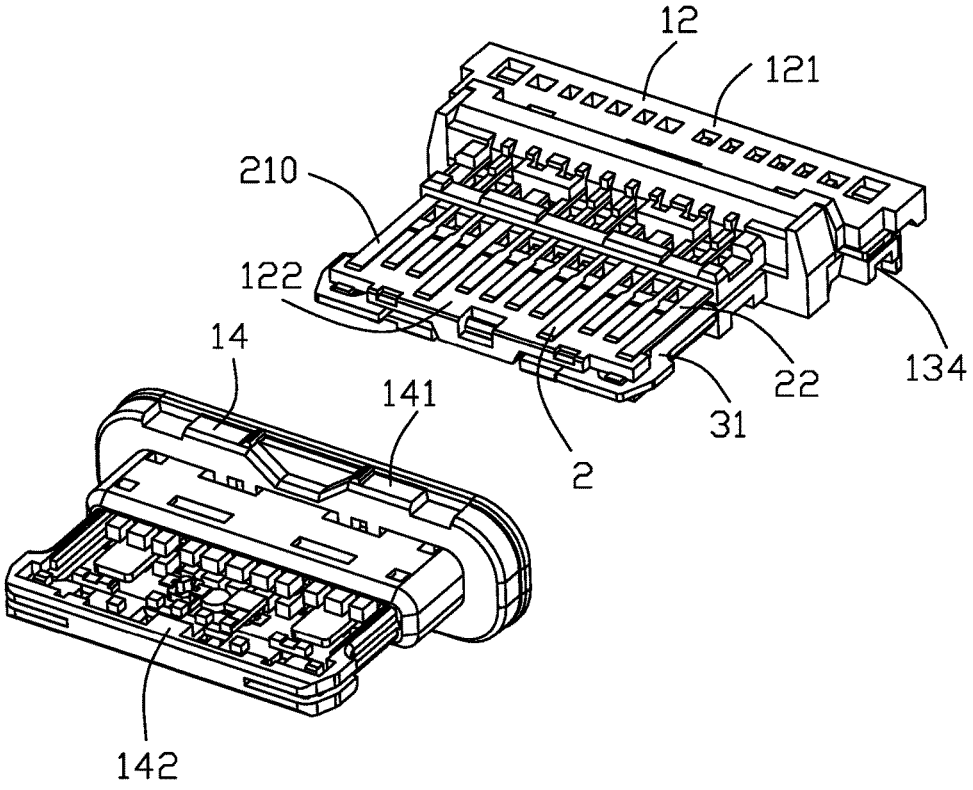
FIG. 7 is a further front downward explode perspective view of the contact module of the electrical connector of FIG. 4.
Figure 8:
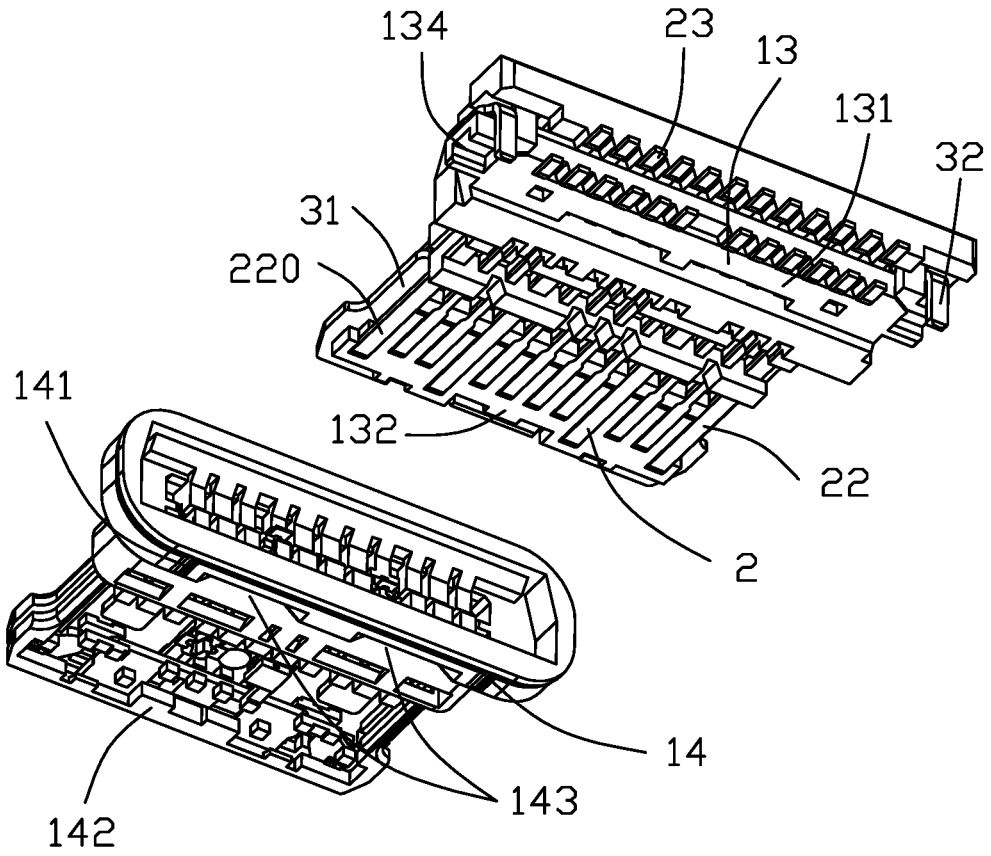
FIG. 8 is a further rear upward exploded perspective view of the contact module of the electrical connector of FIG. 5.
Figure 9:
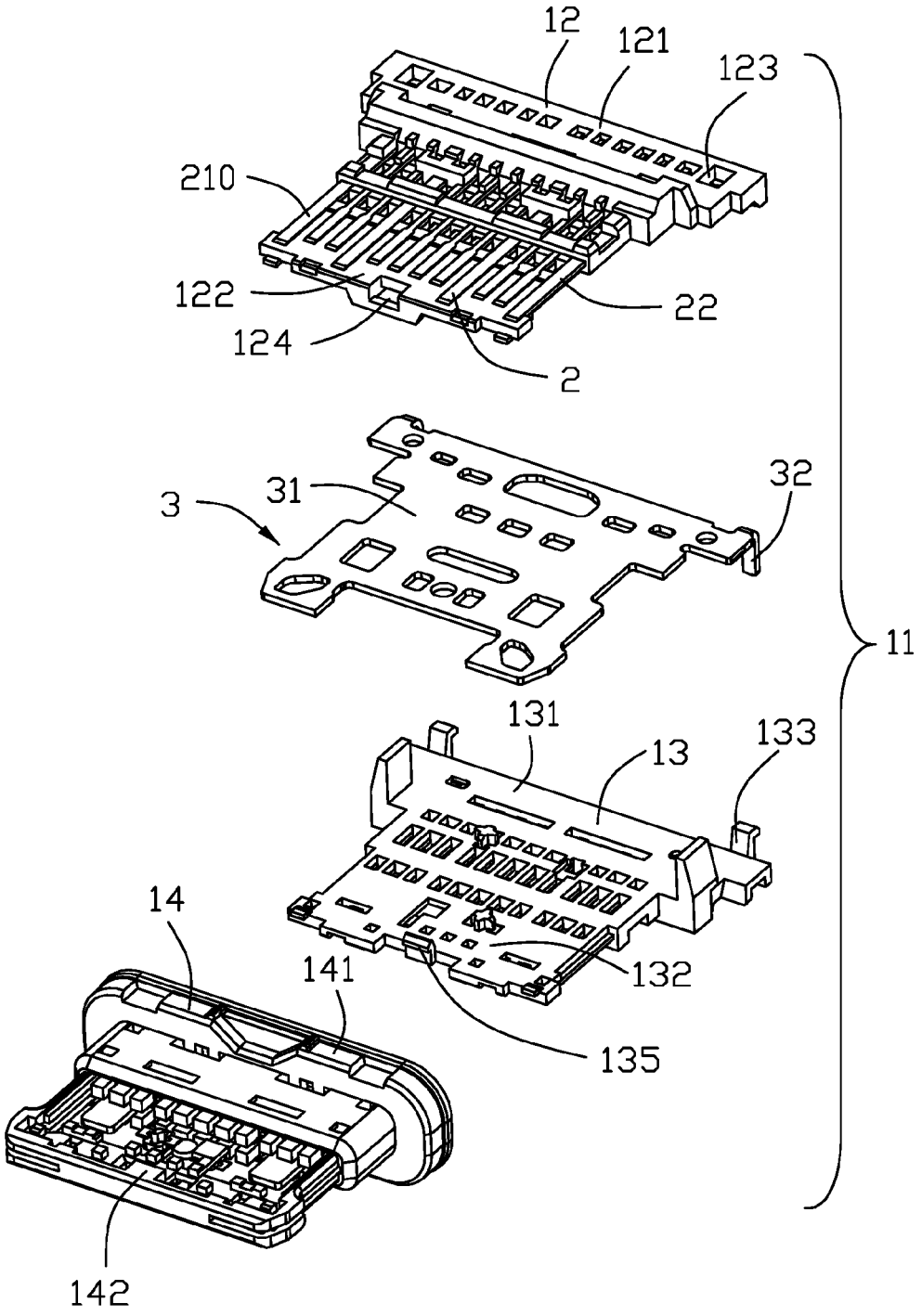
FIG. 9 is a further front downward exploded perspective view of the contact module of the electrical connector of FIG. 7.
Figure 10:
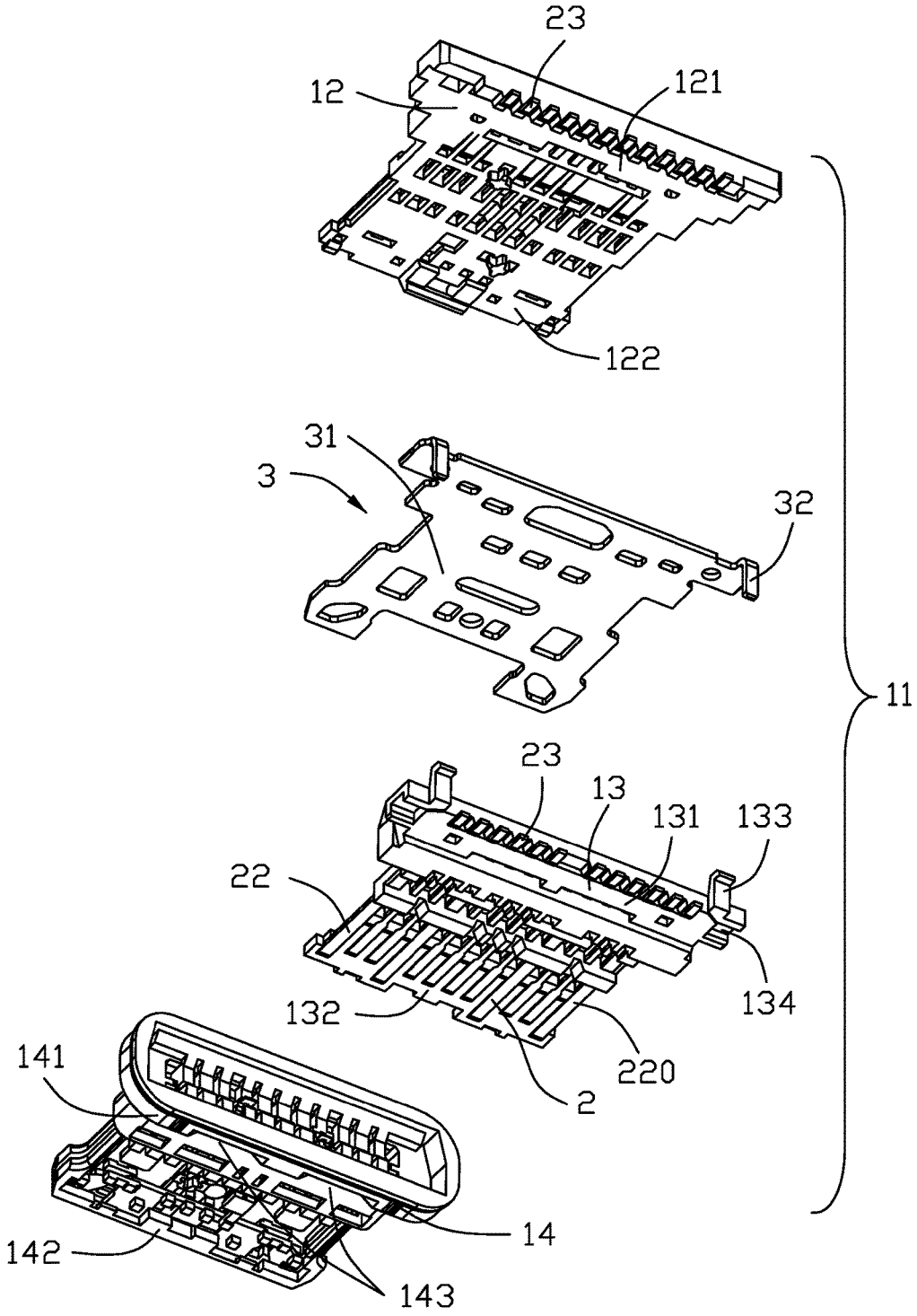
FIG. 10 is a further rear upward exploded perspective view of the contact module of the electrical connector of FIG. 8.
Figure 11:
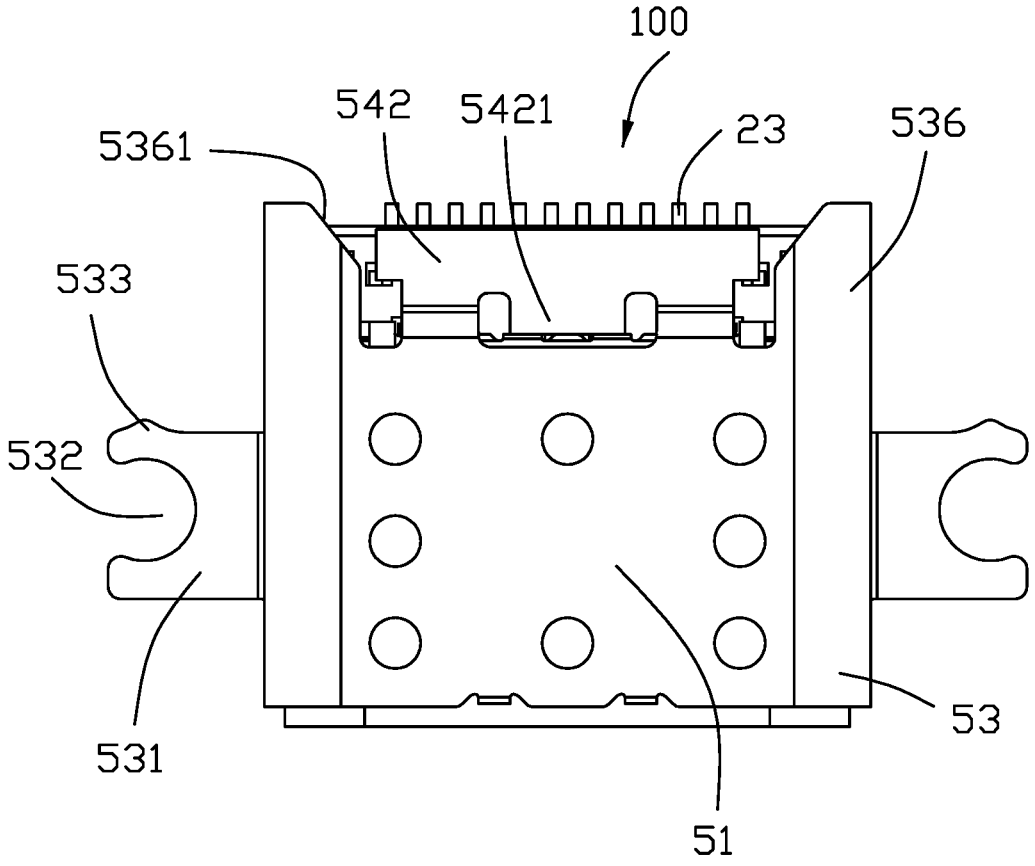
FIG. 11 is a top view of the electrical connector of FIG. 1.
Figure 12:
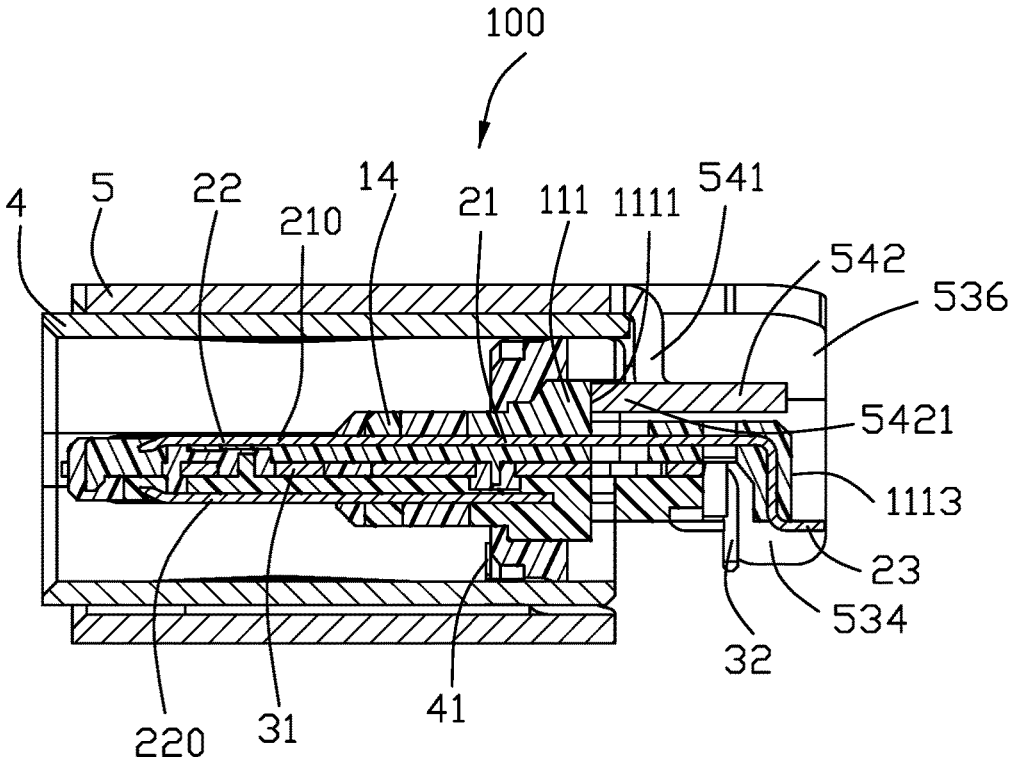
FIG. 12 is a cross-sectional view of the electrical connector of FIG. 1.

Reference will now be made in detail to the embodiments of the present disclosure. Referring to FIGS. 1-14, an electrical card connector 100 form a mating end for receiving a complementary Type C plug connector (not shown) therein along a front-to-back direction.

Referring to FIGS. 1-12, the electrical connector 100 includes a contact module 1, a metallic inner shell 4 enclosing the contact module 1, and a metallic outer shell 5 attached upon the inner shell 4 to commonly form a shell body. The contact module 1 includes an insulative housing 11, a plurality of contacts 2 and a metallic shielding plate 3 commonly retained within the housing 11.

Referring to FIGS. 1-12, the insulative housing 11 includes a base 111 and a tongue portion 112 extending forwardly from the base 111. The insulative housing 11 further includes an upper seat 12, a lower seat 13 and an insulator 14. The upper seat 12 includes a first base 121 and a first tongue portion 122 extending forwardly from the first base 121. The first base 121 includes a pair of first locking sections 123 and the first tongue portion 122 forms a locking hole 124. The lower seat 13 includes a second base 131 and a second tongue portion 132 extending forwardly from the second base 131. The second base 132 forms a pair of second locking sections 133 and a securing groove 134. The second tongue portion 132 forms a locking block 135. The insulator 14 includes a third base 141 and the third tongue portion 142 extending forwardly from the third base 141. The third base 141 forms two positioning grooves 143. The first base 121, the second base 131 and the third base 141 commonly form the base 111. The first tongue portion 122, the second tongue portion 132 and the third tongue portion 142 commonly form the tongue portion 112. The base 111 father includes the upper/first rear face 1111, the second rear face 1112 by two sides of the first rear face 1111, and lower/third rear face 1113 and the step face 1114 connected therebetween. In this embodiment, the step face 1114 is horizontal.

The contact 2 includes the securing section 21, the contacting section 22 extending forwardly therefrom, and the soldering section 23 extending rearwardly therefrom. The contacts 2 further include the upper contacts 210 and the lower contacts 220 arranged reversely symmetrical with each other for allowing dual orientation mating.

The metallic shielding plate 3 includes a main plate 31 and the soldering legs 32 extending rearwardly from the main plate 31. The main plate 31 forms the locking edges (not labeled)

The inner shell 4 encloses the tongue portion of the insulative housing to form a mating cavity 200. The inner shell 4 further includes front abutment sections 41 and rear abutment sections 42. The front abutment sections 41 are formed on an inner surface of the inner shell 4 corresponding to the positioning groove 143. The rear abutment sections 42 extend from a rear edge of the inner shell 4.

The outer shell 5 forms a receiving space 300. The outer shell 7 includes a top wall 51, a bottom wall 52, a pair of side walls 53 and a rear cover 54 extending from the top wall 51. The rear cover 54 includes a cover section 542 and a pair of connection sections 541 with a protrusion/abutting section 5421 therebetween. The side walls further includes front mounting legs 531 and the rear mounting legs 534. The front mounting leg 531 includes a mounting notch 532 and a protrusion 533 thereabouts. The protrusion 533 is located around a periphery and extending in the front-to-back direction for enhancing the mounting leg 531. The side wall 53 further includes a rearward extension 536 with the rear mounting leg 534 thereon. A securing leg 535 is located in front of the rear mounting leg 534 to be received within the securing groove 134. The front mounting legs 531 and the rear mounting legs 534 are used for mounting to the printed circuit board (not shown). The rearward extension 536 forms a tapered surface 5361. The rear mounting leg 534 is located at a rear end of the whole connector.

The method of making the electrical connector 100 includes the following steps:

The upper contacts 210 are integrally formed within the upper seat 12 via an insert-molding process. The lower contacts 220 are integrally formed within the lower seat 13 via another insert-molding process. The upper seat 12 and the lower seat 13 firstly commonly sandwich the shielding plate 3 therebetween, and successively the insulator 14 are applied thereon to form the contact module 200. During assembling, the locking block 135 is received in the locking hole 124, and the first locking section 123 is locked with the second locking section 133. The inner shell 4 encloses the contact module 1 wherein the front abutment sections 41 are received within the corresponding positioning grooves 143 for preventing the forward movement of the contact module 1 with regard to the inner shell 4. The rear abutment sections 42 abut against the second rear face 1112 for preventing the rearward movement of the contact module 1 with regard to the inner shell 4. The outer shell 5 is attached upon the inner shell 4 wherein the securing legs 535 are received within the corresponding securing grooves 134. The rear cover 54 covers the step face 1114. The protrusion 5421 abuts forwardly against the first rear face 1111.

Figure 13:
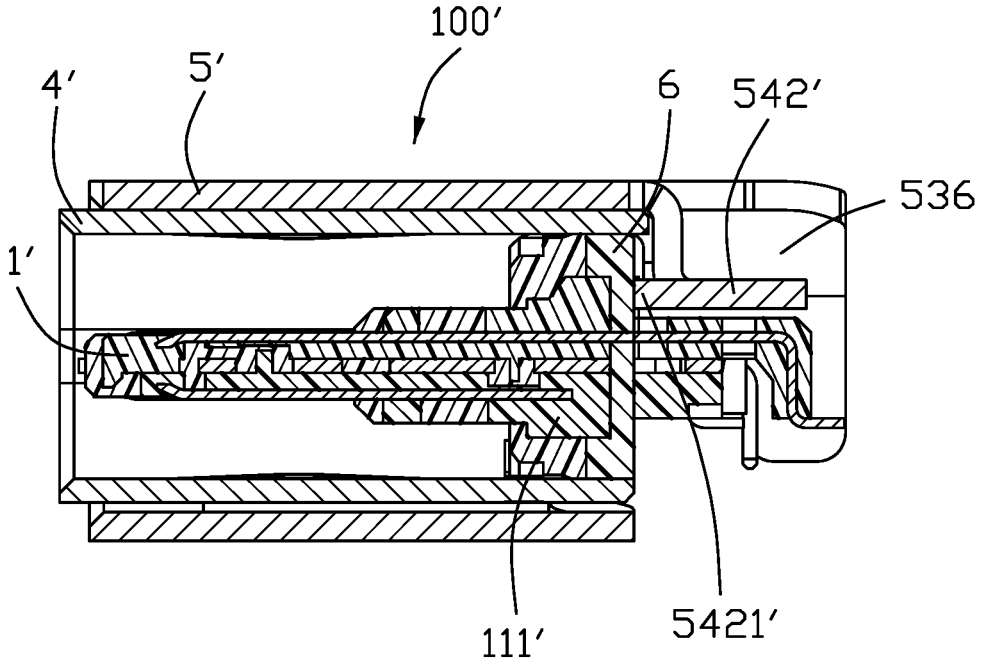
FIG. 13 is cross-sectional view of the electrical connector according to a second embodiment.

Referring to FIG. 13, compared with what is disclosed in the first embodiment, in the second embodiment the connector 1 is further equipped with a glue plate 6 within the inner shell 4' and behind the contact module 1'.

Figure 14:
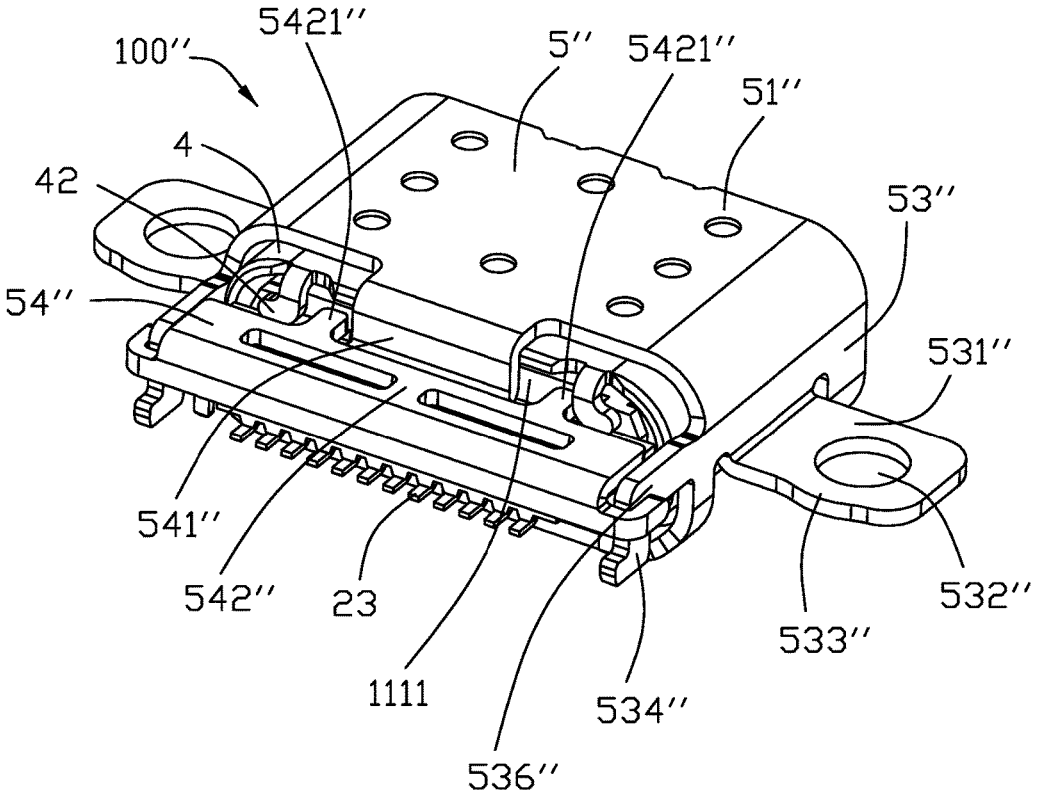
FIG. 14 is a rear downward perspective view of the electrical connector according to a third embodiment.

Referring to FIG. 14, compared with what is disclosed in the first embodiment, in the third embodiment, the front mounting leg 531" includes a mounting hole 532" with a protrusion 533" thereabouts. The protrusions 5421" are located by two sides of the connection section 541".

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a metallic inner shell;

a metallic outer shell attached upon the inner shell;

a contact module received within the inner shell and including a plurality of contacts integrally formed within an insulative housing via insert-molding;

the inner shell forming a front abutment section to rearwardly abut against the insulative housing;

the outer shell forming an abutting section to forwardly abut against the insulative housing; wherein the outer shell further includes a pair of front mounting legs and a pair of rear mounting legs; wherein each of said rear mounting legs extends from a corresponding side wall of the outer shell, and is located at a rear end of the connector; wherein the side wall further includes a securing leg received within a securing groove in the housing.

2. The electrical connector as claimed in claim 1, wherein each of the front mounting legs extends horizontally with a notch therein, and a protrusion on a periphery thereof around said notch.

3. The electrical connector as claimed in claim 1, wherein each of the front mounting legs extends horizontally with a mounting hole therein, and a protrusion on a periphery thereof around said mounting hole.

4. An electrical connector comprising:

a metallic inner shell;

a metallic outer shell attached upon the inner shell;

a contact module received within the inner shell and including a plurality of contacts retained within an insulative housing;

the inner shell forming a front abutment section to rearwardly abut against the insulative housing; and the outer shell including a top wall, a pair of side walls and a rear cover extending unitarily from the top wall; wherein the rear cover includes a vertical connection section unitarily extending downwardly from a rear end of the top wall, a horizontal covering section unitarily extending rearwardly from a lower end of the connection section, and an abutting section unitarily extending forwardly from a front end of the covering section to forwardly abut against the insulative housing; wherein the outer shell includes a pair of front horizontal mounting legs and a pair of rear vertical mounting legs; wherein the outer shell further includes a pair of securing legs located between the pair of front horizontal mounting legs and the pair of rear vertical mounting legs in a front-to-back direction and fixed in a pair of securing grooves in the housing.

5. The electrical connector as claimed in claim 4, wherein the abutting section protrudes forwardly beyond the connection section.

6. The electrical connector as claimed in claim 4, wherein said horizontal covering section vertically shields a rear portion of the housing.

7. The electrical connector as claimed in claim 4, wherein the connection section is located by two sides of the abutting section.

8. The electrical connector as claimed in claim 4, wherein the abutting section is located by two sides of the connection section.

9. An electrical connector comprising:

a shell body including a metallic inner shell and a metallic outer shell attached upon the inner shell;

a contact module received within the inner shell and including a plurality of contacts retained within an insulative housing;

the inner shell forming a front abutment section to rearwardly abut against the insulative housing; and an insulative glue plate enclosed in the inner shell and located behind the housing; wherein said shell body forms a top wall, a pair of side walls and a rear cover extending unitarily from the top wall; wherein the rear cover includes a vertical connection section unitarily extending downwardly from a rear end of the top wall, a horizontal covering section unitarily extending rearwardly from a lower end of the connection section, and an abutting section unitarily extending forwardly from a front end of the covering section to forwardly abut against the insulative glue plate; wherein the outer shell includes a pair of front horizontal mounting legs and a pair of rear vertical mounting legs; wherein the outer shell further includes a pair of securing legs located between the pair of front horizontal mounting legs and the pair of rear vertical mounting legs in a front-to-back direction and fixed in a pair of securing grooves in the housing.

10. The electrical connector as claimed in claim 9, wherein the abutting section protrudes forwardly beyond the connection section.

11. The electrical connector as claimed in claim 9, wherein said horizontal covering section vertically shields a rear portion of the housing.

12. The electrical connector as claimed in claim 9, wherein the connection section is located by two sides of the abutting section.

13. The electrical connector as claimed in claim 9, wherein the abutting section is located by two sides of the connection section.

14. The electrical connector as claimed in claim 9, wherein said rear cover is unitarily formed on the inner shell.

* * * * *